US006176777B1

(12) United States Patent
Smith et al.

(10) Patent No.: US 6,176,777 B1
(45) Date of Patent: Jan. 23, 2001

(54) SELF-MODULATING DIFFUSER FOR AIR CONDITIONING SYSTEMS

(75) Inventors: Grant L. Smith, Lutz, FL (US); Eric G. Laflamme, Calgary (CA); Alfred T. Dyck, Winnipeg (CA); Bruce N. Kettner, Winnipeg (CA); Kenneth G. Lenton, Winnipeg (CA); Charles D. Fraley, Sugar Hill, GA (US); Jason V. Boblinski, Winnipeg (CA)

(73) Assignee: E. H. Price Limited, Manitoba (CA)

( * ) Notice: Under 35 U.S.C. 154(b), the term of this patent shall be extended for 0 days.

(21) Appl. No.: 09/232,734

(22) Filed: Jan. 19, 1999

(30) Foreign Application Priority Data

Jul. 2, 1998 (CA) ..... 2242656

(51) Int. Cl.[7] ..... F24F 13/062
(52) U.S. Cl. ..... 454/256; 454/302; 454/303
(58) Field of Search ..... 454/256, 258, 454/302, 303, 323, 334; 236/49.3, 49.5

(56) References Cited

U.S. PATENT DOCUMENTS

| | | | | |
|---|---|---|---|---|
| Re. 30,953 | | 6/1982 | Vance et al. . | |
| 4,181,253 | * | 1/1980 | Barlow | 454/302 X |
| 4,509,678 | | 4/1985 | Noll . | |
| 4,515,069 | | 5/1985 | Kline et al. . | |
| 4,523,713 | | 6/1985 | Kline et al. . | |
| 5,117,900 | * | 6/1992 | Cox | 454/256 X |
| 5,366,149 | | 11/1994 | Kline . | |
| 5,647,532 | * | 7/1997 | De Villiers et al. | 454/258 X |
| 5,868,313 | * | 2/1999 | Weng | 454/302 X |

FOREIGN PATENT DOCUMENTS

| | | | | |
|---|---|---|---|---|
| 3-50435 | * | 3/1991 | (JP) | 454/258 |
| 5-157343 | * | 6/1993 | (JP) | 454/256 |

* cited by examiner

*Primary Examiner*—Harold Joyce
(74) *Attorney, Agent, or Firm*—Shlesinger, Arkwright & Garvey LLP

(57) ABSTRACT

A self-modulating diffuser for regulating the volume flow of conditioned air from a duct to a selected space, affording a high level of air mixing and sound performance combined with ready control of the space temperature comprises an adjustable square cone plaque-type ceiling diffuser with an outer cone for developing horizontal air flow, a square plaque for attachment to the outer cone and an inner dampening cone positioned intermediate the outer cone and square plaque. Separate first and second sensor means measure the temperature in the duct and in the room space, respectively, and direct digital control means respond to signals from the sensors to produce a control signal which operates an actuator mechanism for adjusting the position of the inner dampening cone.

3 Claims, 4 Drawing Sheets

SELF-MODULATING DIFFUSER FOR AIR CONDITIONING SYSTEMS

BACKGROUND

Square Cone dampening ceiling component diffusers that control airflow, air volume and temperature of supply air into an occupied space are not entirely new.

Most conventional HVAC systems today apply traditional approaches by grouping rooms with similar load characteristics together to form zones. As these zones are created, multiple workspaces are controlled by a single thermostat. "Thermostat wars" ensue as occupants attempt to adjust the thermostat to their level of comfort. Complaints from occupants who are "too hot" or "too cold" are common. Often the system works at capacity to satisfy that one occupant who represents the "worst case" within that zone.

New generation "Smart Diffusers" are relatively new to the industry. Their origin can be traced back to the mid 1980's. The most common of these are ceiling type air control devices, fitted with thermal sensor actuated elements. Such actuators consist of wax filled thermal elements that expand at room temperature (greater than 78 degrees F) to extend shafts that move dampening control devices. A reversed action is achieved on cooling (less than 68 degrees F) when the wax element contracts and is then further spring assisted to cause reverse dampening to a preset location. These thermal (proportionally controlled) diffusers can take up to 30 minutes to adjust to required changes and usually overshoot the preset target temperature, allowing significant temperature swings. Also, the use of springs to reverse damper position can be ineffective if static pressure exceeds 0.25" (WG) water gauge.

GENERAL DESCRIPTION OF THE INVENTION

As of late, more sophisticated ceiling diffusers which contain electron/mechanical dampening devices that modulate when activated by electronic remote transmitters appeared on the market.

The Prodigy™ new self-modulating diffuser according to the present invention is in this general category of modulatable devices. It enhances traditional system design by adding the element of personal control. A room temperature sensor provides constant feedback to the direct digital control (DDC) controller located in the diffuser enabling precise monitoring of the space temperature.

As room load varies, the Prodigy™ compensates by controlling the flow of supply air into the space. A superior cone design maintains air performance characteristics throughout the performance range. Diffuser response is controlled through advanced, adaptive PID control algorithms. Modulation is precise and proportionate to the requirements of the space and the occupant.

The actuator mechanism features a high-torque, low voltage DC motor which offers immediate response, superior to the sluggish response and delayed action common to thermally activated expansion devices. A supply air temperature sensor provides automatic heating/cooling changeover. An output is available to activate supplemental perimeter heating devices if required.

Convenient setpoint adjustment can be achieved through either of two versions of remote devices featuring LED display, and room sensing options.

A BAS interface option expands the application of the Prodigy™ to environments with building automation systems.

The current invention deals with a square cone plaque diffuser that incorporates an adjustable inner cone dampening mechanism that reduces air volume into an occupied space. The diffuser fully integrates with ceiling suspension systems.

The installation of such modulating plaque diffusers are used primarily in personal offices or boardrooms where supply air entering the occupied zone must be quiet and draft-free. The plaque diffuser provides a true 360-degree radial horizontal airflow pattern. The 360-degree radial horizontal airflow promotes rapid mixing of room and supply air, temperature equalization, and velocity reduction. This type of diffuser is ideal for Variable Air Volume (VAV) applications because of its stable and horizontal air patterns at low neck inlet velocities.

SUMMARY OF THE INVENTION

It is an object of the present invention to provide a self-modulating diffuser for regulating the volume flow of conditioned air from a duct to a selected space which affords excellent air mixing and sound performance.

It is a further object of the invention to provide a self-modulating diffuser as aforesaid in which ambient room air is entrained and mixed for maximum comfort level, to eliminate drafts and hot and/or cold zones.

It is a further object of the invention to provide a self-modulating diffuser as aforesaid which affords true variable air volume (VAV) heating and cooling.

It is a further object of the invention to provide a self-modulating diffuser which exhibits a quick response adjustment (cycle time) from fully opened to fully closed.

It is a further object of the present invention to provide a self-modulating diffuser as aforesaid including a direct digital control (DDC) and actuator mechanism for accuracy of temperature and immediacy of response to changes in the occupied zone or in the duct supply air.

With a view to achieving these advantages and allowing for additional features discussed herein, there is provided a self-modulating diffuser for regulating the volume flow of conditioned air from a duct to a selected space, which comprises an adjustable square cone plaque-type ceiling diffuser which has as its three principal structural components (i) an outer cone for developing horizontal airflow, (ii) a square plaque for attachment to the outer cone and (iii) an inner dampening cone which in use is positioned intermediate the outer cone and the square plaque. The diffuser according to the invention also comprises first sensor means for measuring the temperature in the duct, second sensor means for measuring the temperature in the room space and direct digital control (DDC) controller means responsive to signals from the first and second sensor means, operable to produce a control signal to the actuator mechanism for adjusting the position of the inner dampening cone.

In the preferred embodiment of the invention, the actuator means comprises a high-torque low voltage DC motor, for longevity and reliability.

According to a further embodiment of the invention, the second sensor means for measuring the space temperature is centrally mounted on the plaque of the diffuser and has a temperature set point which is adjustable by remote means, either a hand-held infrared remote or a radio-frequency remote.

Advantageously, a housing is provided to contain the actuator (drive) mechanism, fabricated from durable square extruded aluminum post and the actuator means is itself made of durable plastic and includes a tangential force reduction bushing for quick response.

DETAILED DESCRIPTION OF PREFERRED EMBODIMENTS

Figure 1A:
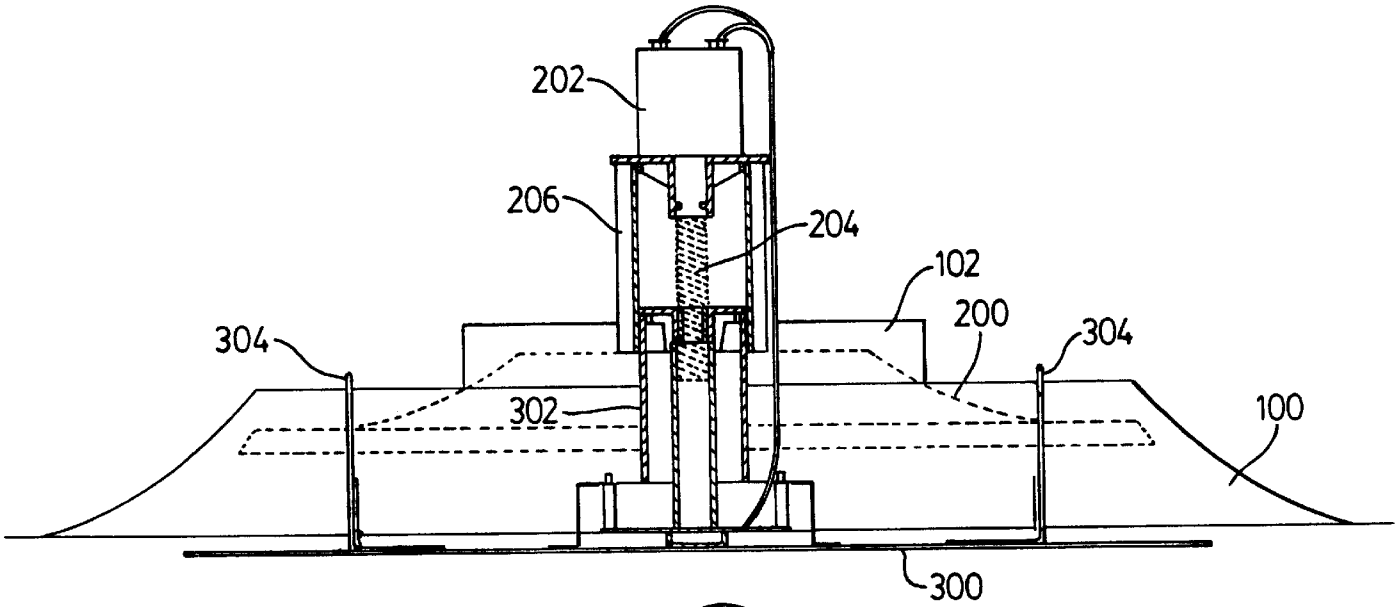
FIGS. 1*a* and 1*b* are vertical sectional illustrations of a fully adjustable square cone plaque-type ceiling diffuser according to the present invention, respectively showing the modulating inner damper cone sub-assembly in its fully closed position and in its fully opened position.
Figure 1B:
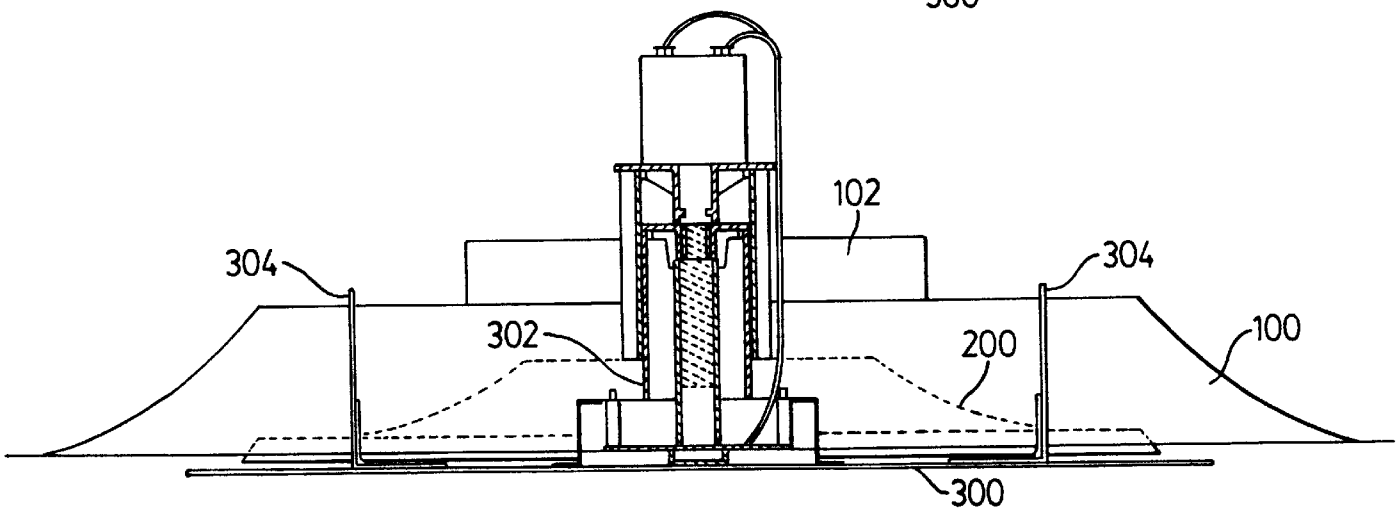
Figure 2:
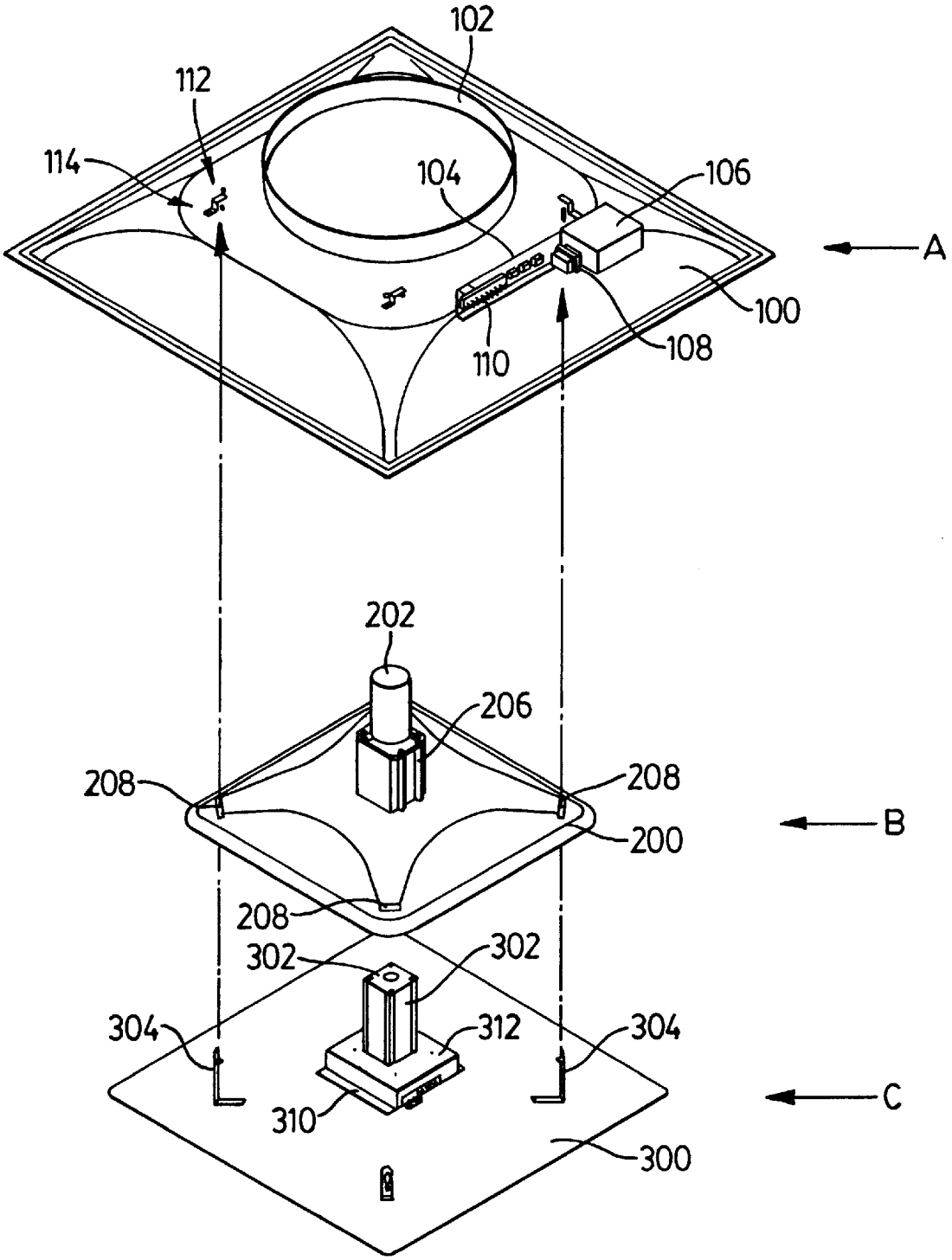
FIG. 2 is an exploded perspective view of a ceiling diffuser of the kind shown in FIG. 1, showing the spatial relationship between the outer cone, inner damper cone and the square plaque sub-assemblies.

As best seen in drawing FIGS. 1*a*, 1*b* and 2, a fully adjustable square cone plaque-type ceiling diffuser according to the present invention comprises three principal components: (i) an outer cone sub-assembly, an inner damper core sub-assembly and a square plaque sub-assembly indicated in the exploded view of FIG. 2 by arrows A, B and C, respectively.

In the preferred embodiment illustrated in the drawings, the outer cone sub-assembly A comprises an outer cone 100 which is preferably die-formed of steel sheet metal for use in T-bar lay in ceiling systems. The inner damper cone sub-assembly B includes an inner dampening cone 200, also preferably die-formed of steel sheet metal. The inner dampening cone is adapted to move along the vertical axis on the centre line of the diffuser for increasing or decreasing supply air entering the occupied zone. Inner dampening cone 200 is positioned intermediate cone 100 and stationary plaque 300 of the square plaque sub-assembly C and moves axially up and down along the space between them.

As best seen in FIGS. 1*a* and 1*b*, the up-and-down motion of inner cone 200 between outer cone 100 and square steel plaque 300 is effected by a motor end drive shaft arrangement which in the preferred embodiment shown comprises a 12 volt DC motor 202 and a ½0 inch diameter acme thread 204. This acme thread 204 in its rotation acts as a drive mechanism for the inner dampening cone by coupled motion of a square extruded aluminum housing 206 which is centrally secured to the top of inner damper cone 200 and slides up and down on a mating square stationary extruded aluminum post 302 of the square plaque sub-assembly.

Cone position may be determined and "remembered" by a conventional DDC controller and the use of an inductor coil mechanism mounted directly on a circuit board. As the acme threat 402 rotates to move the inner cone 200 up or down, the inductor coil measures the amount of acme threat still inside it and, from this measurement, the circuit board will automatically sense the position of the inner cone.

More detailed particulars of the components in each sub-assembly of the Prodigy self-modulating diffuser are given in the discussion of subsequent drawings which follows.

Sub-Assemblies of Principal Components

A Outer Cone Sub-Assembly

Figure 3A:
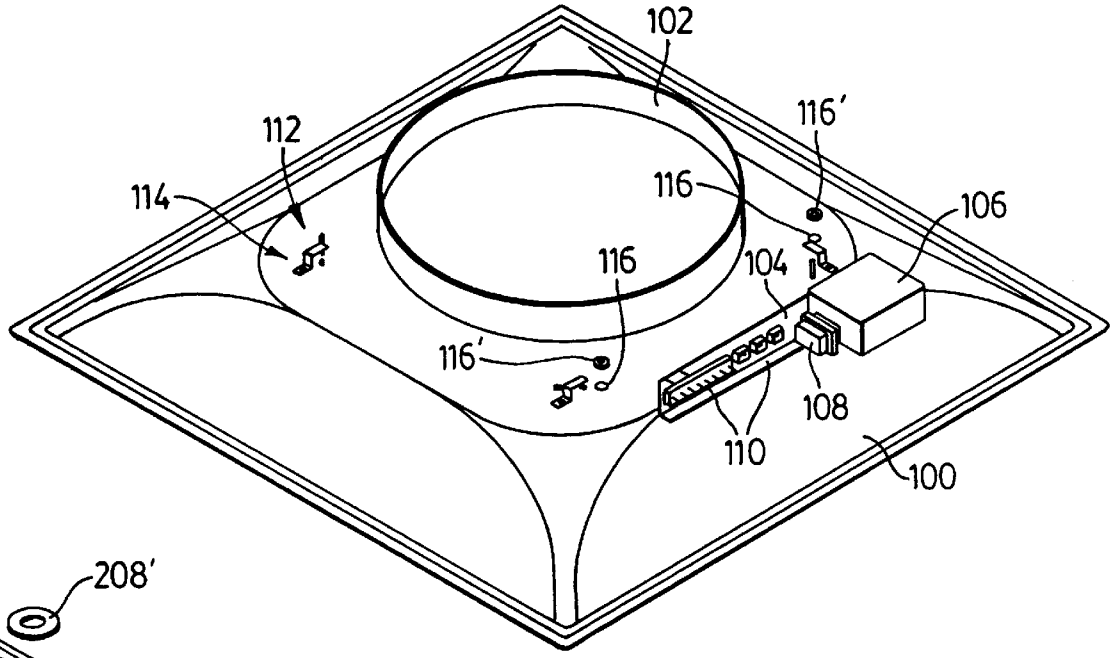
FIGS. 3*a*, 3*b* and 3*c* are exploded views of particular preferred embodiments of a square plaque sub-assembly, an inner damper cone sub-assembly and an outer cone sub-assembly, respectively, for use in a fully adjustable square cone plaque-type ceiling diffuser according to the present invention.

As best seen in FIGS. 2 and 3*a*, steel outer cone 100 opens upwardly into the ducting via an integral round neck inlet 102 which may be of any selected diameter. Outer cone 100 is furnished with an angle bracket 104 to accommodate an electrical junction box 106 and a 24 V transformer 108, for power, electrical connectors 110 for drone and accessory connection, punched slots 112 and rivetted offset clips 114 for engagement of the square plaque 300 and punched hole 116 including rubber grommets 116' for electronic wire routing.

B. Inner Damper Cone Sub-Assembly

Figure 3B:
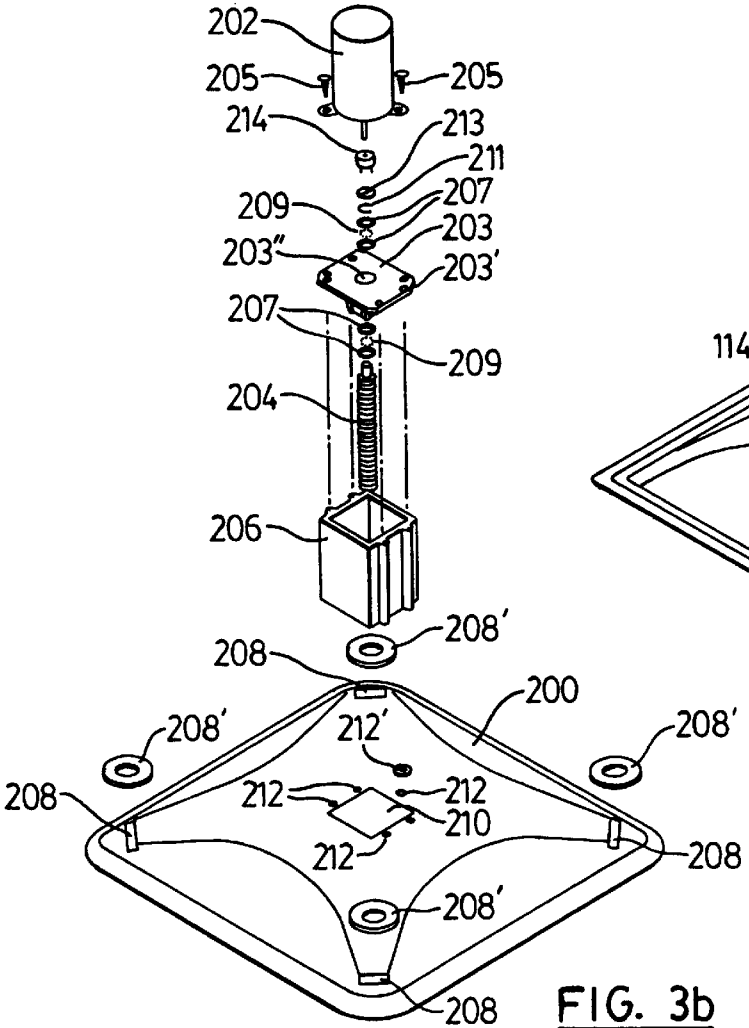

As best seen in FIGS. 2 and 3*b*, steel dampening cone 200 of die-formed steel sheet metal is furnished with four rectangular holes 208 disposed to the corners thereof, each with a vinyl vibration isolator 208'. A square punched hole 210 at dead centre and five round holes 212 with respective grommets 212' accommodate the aforementioned extruded aluminum housing 206. Of constant cross-section, extruded aluminum housing 206 is used to slide over the extruded aluminum post 302 and plastic threaded cap 302' of the square plaque sub-assembly, thereby providing stability to the up-and-down movement of inner damping cone 200.

Motor drive plate 203, preferably made of Celcon M90 (trademark) furnishes five holes 203' for screws 205 to connect the 12 volt DC motor 202 to extruded aluminum housing 206. Motor drive plate 203 includes a cavity along the vertical central line to accommodate four washers 207 twenty ball bearings 209, a C-clip 211, a universal floating disk 213, the aforementioned ½ inch acme thread 204 and a drive coupling 214, to move inner damping cone 200.

C Square Plaque Sub-Assembly

Figure 3C:
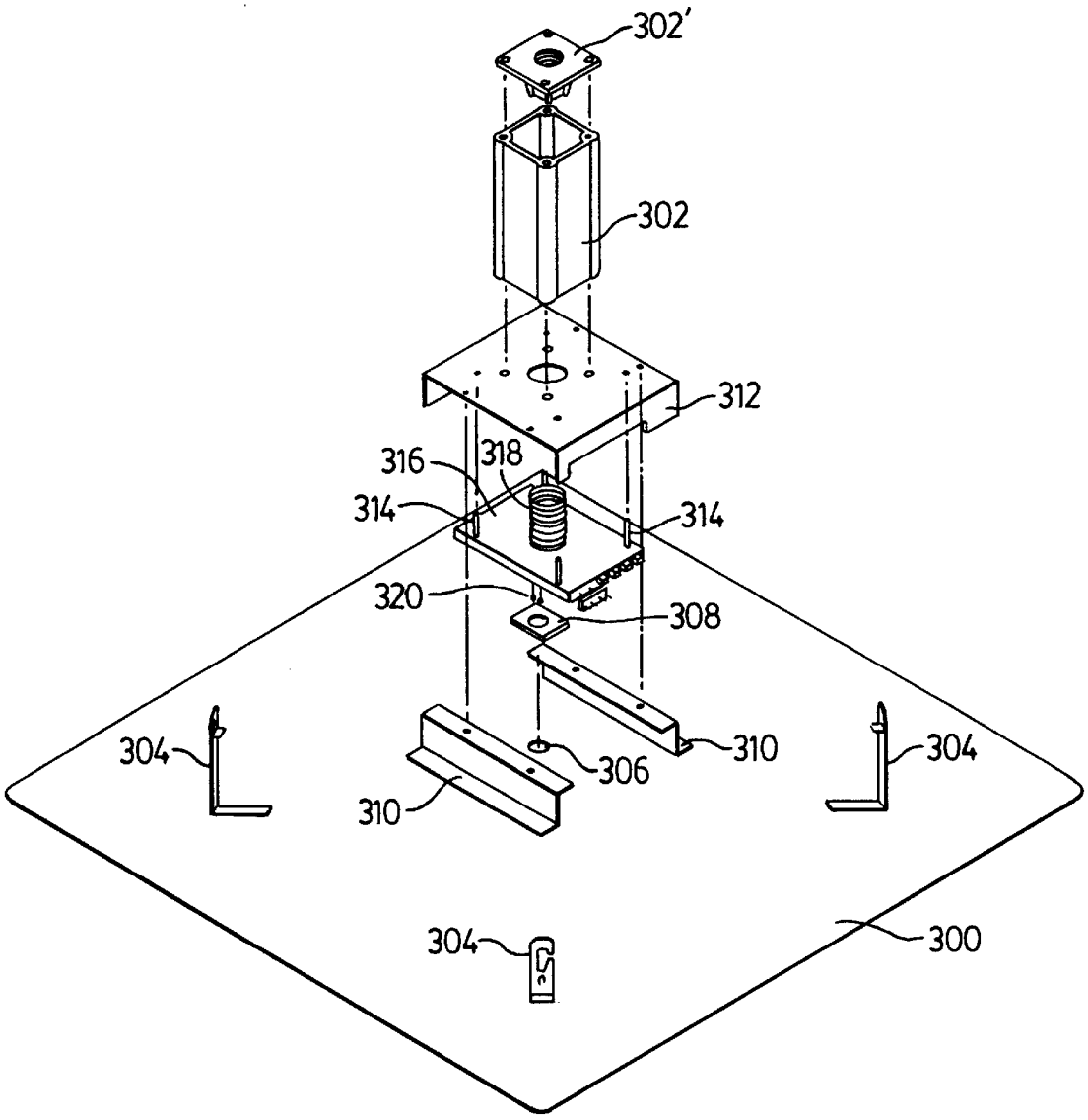

As best seen in FIGS. 2 and 3*c*, sheet metal square plaque 300 is fitted with four integral plaque arms 304 adapted to attach plaque 300 to and supported against outer cone 100. A central hole 306 through plaque 300 accommodate a signal and temperature sensing lens 308. Two Z-shaped brackets 310 are spot welded to plaque 300 for attachment thereto of a plaque casing 312 which, in conjunction with four spaces 314 fit together to form a housing for the circuit board 316, the inductor coil 318 and the two thermistors 320 for measuring the space temperature, which is compared with the duct temperature (sensors not shown) to control the movement of the inner damping cone 100. Screws are used to attach the plaque casing 312 to the extruded aluminum post 302 with plastic threaded cap 302' which, as described above, mates with extruded aluminum housing 206 of the inner damper cone sub-assembly to drive and support inner damping cone 200.

The plastic threaded cap 302' which fits over extruded aluminum post 302 is adapted to receive the ½ inch acme thread 204 of the inner damper cone sub-assembly. As thread 204 rotates, inner damping cone 100 will move up or down as required.

Fabrication and Assembly Sequence

1. Take pre-fabricated cone 100 to punching station. Punch holes for offset clips 114 and rubber grommets 116'.
2. Take outer cone 100 to rivetting machine and rivet four offset clips 114.
3. Take outer cone 100 to spot welding machine and spot weld angle bracket 104.
4. Take outer cone to paint line.
5. Die-form inner damping cone 200 and take to punching station. Punch rectangular holes 208 and square hole 210, also five round holes 212.
6. Attach aluminum extruded housing 206 to inner damping cone 200 using four screws.

7. Take inner damping cone sub-assembly to paint line.
8. Punch hole 306 in centre of pre-fabricated square plaque 300.
9. Take to spot welding machine and spot-weld four plaque arms 304 and two Z-shaped brackets 210 onto plaque.
10. Take square plaque sub-assembly to paint line.
11. Take aluminum extrusion 302 and plaque casing 312 to paint line. With all parts described above painted, take to final assembly area.
12. Attach transformer 108 to junction box 106. Using screws attach this assembly to angle bracket 104. Secure electrical connectors 110 to bracket 104 using screws.
13. Insert two rubber grommets 116' into holes 116.
14. Insert one rubber grommet 212' into one hole 212.
15. Apply four vinyl vibration isolators 208' over rectangular holes 208, using adhesive.
16. Using screws, attach extruded aluminum housing 206 to inner damping cone 200 through four remaining bracket ungrommetted holes 212.
17. Instal one washer 207 onto acme thread 204. Insert one washer 207 into bottom cavity of motor drive plate 203. Insert ten ball bearings 209 into bottom cavity of motor drive plate 203. Insert top of acme thread 204 into bottom cavity of motor drive plate 203. Insert one washer 207 and ten ball bearings 209 into the cavity of motor drive plate 203. Insert one washer 207 and one C-clip into top cavity of motor drive plate 203. Secure C-clip in place to lock assembly.
18. Instal universal floating disk 211 into top cavity.
19. Insert drive coupling 214 onto shaft of motor 202 and tighten using locking screw.
20. Secure motor 202 onto motor drive plate 203 with two screws 205.
21. Secure motor and motor drive plate sub-assembly to extruded aluminum housing 206 using four thread cutting screws.
22. Attach extruded aluminum post 302 to plastic cap 302' and plaque casing 312, using thread cutting screws.
23. Insert lens 308, circuit board 316, thermistors 320 and inductor coil 318 and secure to plaque casing 312 using four spacer studs 314 with threaded ends, using hexagonal nuts to complete the sub-assembly.
24. Using four sheet metal screws, attach plaque casing sub-assembly to Z-shaped brackets 310.
25. Attach square plaque sub-assembly C to inner damping cone sub-assembly B by sliding extruded aluminum housing 206 over extruded aluminum post 302.
26. Attach above conjunction of assemblies B and C to outer cone assembly A by inserting the four plaque arms 304 to lock in place.

Additional Features and Advantages

Individual comfort control by monitoring space conditions and regulating the flow of supply air to maintain the room set point with and accuracy of ±0.5° F.

Immediate response to room load using direct digital control signals (adaptive PID algorithms) and a 12-volt DC direct drive motor.

Cone positioning indicator coil senses the inner cone position and relays it back to the main circuit board.

True VAV cooling and heating modes. Automatic heating/cooling changeover.

Superior horizontal air performance created by the aerodynamic inner dampening cone sub-assembly. Throws and mixing of supply and room air remain constant.

Infrared remote device used for set point change. Radio frequency device supports set point adjustment and room temperature sensing. (Refer to "Prodigy" literature for model selection)

A pulsed 24-volt AC output for perimeter heating devices such as a baseboard unit or radiant panels.

Prodigy supports BAS (Building automation systems). Outputs for CFM, set point, offset, and room temperature are available.

One master unit will support up to 5 drone units for system control.

Please refer to E. H. Price Limited literature describing the Prodigy diffuser series, including available models and options.

Design Differences Over Existing Patents

1. Aerodynamic formed inner dampening cone that maintains horizontal air performance.
2. Adaptive PID (Fuzzy Logic) controls to adapt to room load changes.
3. 12-volt DC direct drive motor to provide immediate response to changes operator set point or room load.
4. Stationary plaque post (extr. alum.) mating slidably with extr. alum. housing of inner dampening cone to ensure stability for up and down movement.
5. ½" dia. acme thread drive shaft that corresponds with internal thread of plastic cap on stationary extr. alum. post of plaque sub-assembly for direct drive of inner dampening cone.
6. Universal bushing mechanism including ball bearings to reduce tangential forces on motor shaft for longer wear.
7. Temperature sensing and transmission receiving lens, strategically positioned at centre of plaque face to provide 360-degree signal receiving radius.
8. Junction box and 24 V-DC transformer supplied with diffuser for 115/277 V-AC field power connection.
9. Positive inductor coil surrounds motor drive shaft. Measures inner dampening cone position and relays it back to circuit board.

We claim:

1. Self-modulating diffuser for regulating the volume flow of conditioned air from a duct to a selected space, comprising:

(a) adjustable square cone plaque-type ceiling diffuser, including:
  (i) an outer cone for developing horizontal airflow;
  (ii) a square plaque for attachment to said outer cone;
  (iii) an inner dampening cone positioned between said outer cone and said square plaque when said square plaque is attached to said outer cone; and
  (iv) actuator mechanism for adjusting the vertical position of said dampening cone to change the volume rate of air supplied by the diffusers (b) first sensor for measuring the duct temperature;

(c) second sensor for measuring the space temperature; and (d) direct digital controller responsive to signals from said first and second sensors and for producing a control signal to said actuator mechanism for adjusting the position of said inner dampening cone.

2. Self-modulating diffuser according to claim 1, wherein said actuator mechanism comprises a high-torque, low-voltage DC motor.

3. Self-regulating diffuser according to claim 2, wherein said second sensor is centrally mounted on the plaque of the diffuser and further comprising remote means for temperature set point adjustment of said second sensor.

* * * * *